US005603517A

United States Patent [19]

Lorman

[11] Patent Number: 5,603,517

[45] Date of Patent: Feb. 18, 1997

[54] WALKERS

[75] Inventor: Shmil Lorman, Petah-Tikva, Israel

[73] Assignee: Siudon Ltd., Haifa, Israel

[21] Appl. No.: 546,327

[22] Filed: Oct. 20, 1995

Related U.S. Application Data

[63] Continuation-in-part of Ser. No. 246,455, May 20, 1994, abandoned.

[51] Int. Cl.[6] ..... A61H 3/04

[52] U.S. Cl. ..... 280/5.2; 280/641; 280/87.021; 135/67; 188/1.12; 188/29; 297/5; 301/43

[58] Field of Search ..... 301/43; 280/250.1, 280/30, 87.021, 87.05, 87.051, 657, 5.2, 5.32, 642, 641, 38, 647, 87.041, 47.36, 47.371; 135/67, 66, 74; 297/5.6; 188/1.12, 19, 20, 29, 68, 69; 482/66, 67, 68

[56] References Cited

U.S. PATENT DOCUMENTS

| | | | |
|---|---|---|---|
| D. 181,957 | 1/1958 | Callahan | 482/68 |
| 1,446,427 | 2/1923 | Matteson | 301/43 |
| 1,709,527 | 4/1929 | Ford . | |
| 1,917,440 | 7/1933 | Finkbeiner et al. . | |
| 2,077,569 | 4/1937 | Kish . | |
| 2,658,587 | 11/1953 | Velazquez | 188/20 |
| 2,708,473 | 5/1955 | Gable et al. . | |
| 2,958,537 | 11/1960 | Young . | |
| 3,090,470 | 5/1963 | Abrams . | |
| 3,174,768 | 3/1965 | Sanders et al. . | |
| 3,176,700 | 4/1965 | Drury, Jr. . | |
| 3,200,907 | 8/1965 | Hansen . | |
| 3,237,940 | 3/1966 | Johnson | 297/5 |
| 3,279,567 | 10/1966 | Kempel . | |
| 3,350,095 | 10/1967 | Clasen . | |
| 3,356,185 | 12/1967 | Isaacks . | |
| 3,387,617 | 6/1968 | Reiber . | |
| 3,387,618 | 6/1968 | Swann . | |
| 3,421,529 | 1/1969 | Vestal . | |
| 3,455,313 | 7/1969 | King . | |
| 3,658,079 | 4/1972 | Block . | |
| 3,800,815 | 4/1974 | Birk . | |
| 3,840,034 | 10/1974 | Smith . | |
| 4,018,440 | 4/1977 | Deutsch | 272/70.3 |
| 4,029,311 | 6/1977 | Chanslor et al. | 272/70.3 |
| 4,094,331 | 6/1978 | Rozza | 135/67 |
| 4,211,309 | 7/1980 | Ruggiero | 280/87.02 |
| 4,312,505 | 1/1982 | Engelhart | 272/70.3 |
| 4,384,713 | 5/1983 | Deutsch et al. | 272/70.3 |
| 4,385,769 | 5/1983 | Molino | 188/20 |
| 4,411,283 | 11/1983 | Lucarelli | 135/67 |
| 4,461,471 | 7/1984 | Brastow | 272/70.3 |
| 4,633,980 | 1/1987 | Lambertson . | |

(List continued on next page.)

FOREIGN PATENT DOCUMENTS

| | | | |
|---|---|---|---|
| 2056148 | 5/1993 | Canada | 135/67 |
| 1342397 | 1/1974 | United Kingdom | 135/67 |

*Primary Examiner*—Anne Marie Boehler
*Attorney, Agent, or Firm*—Mark M. Friedman

[57] ABSTRACT

A rollable walker for traversing stairs and substantially level surfaces, comprising a frame which includes a left and a right upright members, the left and right upright members including front legs, and an upper segment. The frame further includes a crossbar which is pivotaly connected to the left and a right upright members, the crossbar including a generally U-shaped transverse element and vertically disposed segments acting as rear legs. The crossbar is supported by supporting means. The supporting means is attached or integrally formed with the left and right upright members. A pair of rear wheels and a pair of front wheels engaged by wheel mounts, each wheel having two vertical planar surfaces. The rear wheels are connected to the rear legs, whereas the front wheels are connected to the front legs. The vertical planar surfaces of the wheels are surrounded by protrusions; and, two pairs of braking devices connected to the rear and front legs, each of the braking devices is slidably supported by one of the wheel mounts over one of the wheels in such a way that the application on the frame of a downward force of a magnitude greater than a pre-determined value urges the braking devices against the wheels to brake the walker.

12 Claims, 7 Drawing Sheets

U.S. PATENT DOCUMENTS

| | | | |
|---|---|---|---|
| 4,643,211 | 2/1987 | Morris | 135/67 |
| 4,765,355 | 8/1988 | Kent | 135/67 |
| 4,777,973 | 10/1988 | Nakajima | 135/67 |
| 4,830,035 | 5/1989 | Liu | 135/67 |
| 4,869,279 | 9/1989 | Hedges | 135/67 |
| 4,883,282 | 11/1989 | Wolf et al. | 280/43.24 |
| 4,922,940 | 5/1990 | Lewy | 135/67 |
| 4,941,496 | 7/1990 | Berning | 135/67 |
| 5,020,560 | 6/1991 | Turbeville | 280/282 |
| 5,046,748 | 9/1991 | Oat-Judge | 280/47.34 |
| 5,058,912 | 10/1991 | Harroun | 280/87.021 |
| 5,263,506 | 11/1993 | Norramore | 135/67 |
| 5,271,422 | 12/1993 | Sorrell et al. | 135/66 |
| 5,277,438 | 1/1994 | Chuang | 280/42 |

WALKERS

This is a continuation in part of U.S. patent application Ser. No. 08/246,455, filed May 20, 1994 now abandoned.

FIELD AND BACKGROUND OF THE INVENTION

This invention relates to the field of walkers in general and, in particular, to rollable walkers for traversing stairs as well as substantially level surfaces.

Walkers can be broadly broken down into two categories in which the first category of walkers includes walkers designed to provide assistance while traversing substantially level surfaces and the second category of walkers include walkers designed to provide assistance while traversing stairs as well as substantially level surfaces.

Walkers for traversing substantially level surfaces generally include a four-legged frame as disclosed in U.S. Pat. No. 4,987,912 to Taylor and U.S. Pat. No. 4,993,446 to Yarbrough, and suffer from the disadvantage that they have to be lifted during ambulation, thereby causing a high degree of fatigue of the user. To overcome the problem of having to lift walkers, rollable walkers have been developed which include the provision of at least one pair of ground engaging wheels, casters or gliders as disclosed in U.S. Pat. No. 4,941,496 to Berning, U.S. Pat. 4,953,851 to Sherlock, U.S. Pat. No. 4,907,794 to Rose and others. However, rollable walkers suffer from the disadvantage of being somewhat unstable.

Other improvements over these walkers include the provision of a seat, sling or similar sitting device as disclosed in U.S. Pat. No. 4,907,839 to Rose et al. and the provision of foldable frames for minimizing their storage space requirements and for facilitating their portability when they are not in use.

Walkers for traversing stairs as well as substantially level surfaces also generally include a four-legged frame as disclosed in U.S. Pat. Nos. 4,941,496 to Berning; 3,176,700 to Drury; 3,387,618 to Swann; 4,094,331 to Rozsa; 4,411,283 to Locarelli; and, 3,421,529 to Vestal. As far as traversing stairs, these walkers suffer from the disadvantage that they have to be adjusted to the stairs geometry (i.e., the width and height of each stair in a stairway). Furthermore, these walkers have a characteristic upright build-up (i.e., a narrow base geometry,) and therefore are less stable when leaned upon by a user ascending or descending stairs. Further disadvantages of known walkers for traversing stairs such as the one disclosed in U.S. Pat. No. 4,922,940 to Lewy, are that there is no provision to accommodate the different postures taken up by the user depending on whether he is climbing or descending stairs or traversing substantially level surfaces. In addition, these walkers are not rollable, therefore they suffer from the above described disadvantage that they have to be lifted during ambulation, thereby causing a high degree of fatigue of the user.

There is therefore a need for walkers for traversing stairs as well as substantially level surfaces which overcome the above disadvantages.

SUMMARY OF THE INVENTION

The main object of the present invention is to provide a rollable walker for traversing stairs and substantially level surfaces.

Most users of walkers accomplish ambulation by repetitively lifting up and placing the walker in a forward position while standing still and taking a step forward while relying upon the walker for balance and support. Other users, who are unable to lift the walker, advance the walker by lifting one side of the frame at a time and pivoting the frame about the foot remaining on the ground. In both cases, it is true to say that the user particularly relies upon the walker for balance and support when he is taking a step forward and not when he is advancing the walker. Therefore, it can be appreciated that the design of a walker should accomplish two main goals. First, that the walker can be rolled on ground engaging wheels, rollers, casters and the like, thereby obviating the need for completely or partially lifting the walker. And second, that the inherent destabilizing effect of wheels be negated when the user is relying on the walker for balance and support.

Hence, to achieve the above-mentioned goals, there is provided according to the present invention, a rollable walker for traversing stairs and substantially level surfaces, comprising: (a) a frame including (i) a left and a right upright members, the left and right upright members including front legs, and an upper segment, and (ii) a crossbar being pivotaly connected to the left and a right upright members, the crossbar including a generally U-shaped transverse element and substantially vertically disposed segments acting as rear legs; the crossbar being supported by supporting means, the supporting means being attached or integrally formed with the left and right upright members; (b) a pair of rear wheel mounts engaging a pair of rear wheels, each of the rear wheels having two vertical planes, the rear wheels being connected to the rear legs, the vertical planes of the rear wheels being surrounded by protrusions; (c) a pair front wheel mounts engaging a pair of front wheels, each of the front wheels having two vertical planes, the front wheels being connected to the front legs, the vertical planes of the front wheels being surrounded by protrusions; (d) two pairs of braking devices connected to the rear and from legs each of the braking devices being slidably supported over one of the wheels in such a way that the application on the frame of a downward force of a magnitude greater than a predetermined value urges the braking devices against the wheels to brake the walker.

According to further features in preferred embodiments of the invention described below, each one of the braking devices includes a compression spring having one end rigidly mounted to one of the legs and a second end rigidly mounted to one of the wheel mounts such that the compression spring supports at least a portion of the weight of the frame.

According to further features in preferred embodiments of the invention described below, each one of the braking devices further includes a lower rim of the leg, wherein the lower rim is configured to receive the wheel, such that the compression spring governs the clearance between the lower rim and the wheel as a function of the load borne by the compression spring.

According to further features in preferred embodiments of the invention described below, the frame further includes a first pair of handles, wherein each one of the handles of the first pair of handles is connected to one of the upper segment and is substantially deployed over one wheel of the pair of rear wheels.

According to further features in preferred embodiments of the invention described below, the frame further includes a second pair of handles, wherein each one of the handles of the second pair of handles is connected to one of the upper segment below the handles of the first pair of handles and is substantially deployed over one wheel of the pair of rear wheels or, alternatively, each one of the handles of the second pair of handles is connected to the supporting means and is substantially deployed over one wheel of the pair of front wheels.

According to further features in preferred embodiments of the invention described below, the front legs form an angle with the vertical, the angle substantially equals to the inclination angle of a stairway relative to the horizontal.

According to further features in preferred embodiments of the invention described below, the rear legs form an angle with the vertical, the angle substantially equals to half the inclination angle of a stairway relative to the horizontal.

According to further features in preferred embodiments of the invention described below, the walker further comprising a foldable seat connected to the frame for supporting a user in a sitting position.

According to further features in preferred embodiments of the invention described below, the front legs and the rear legs are spaced so that when the walker is used for traversing stairs the pair of front wheels engage a first stair of a stairway and the pair of rear wheels engage a second stair of a stairway, the first and the second stairs are spaced by a third stair of the stairway.

According to further features in preferred embodiments of the invention described below, the pivotal connection between the crossbar and the left and a right upright members is for folding the walker.

BRIEF DESCRIPTION OF THE DRAWINGS

The invention herein described, by way of example only, with reference to the accompanying drawings, wherein.

DESCRIPTION OF THE PREFERRED EMBODIMENTS

The present invention is of rollable walkers for traversing stairs as well as substantially level surfaces.

The principles and operation of the walkers according to the present invention can be better understood with reference to the drawings and the accompany description.

Figure 1:
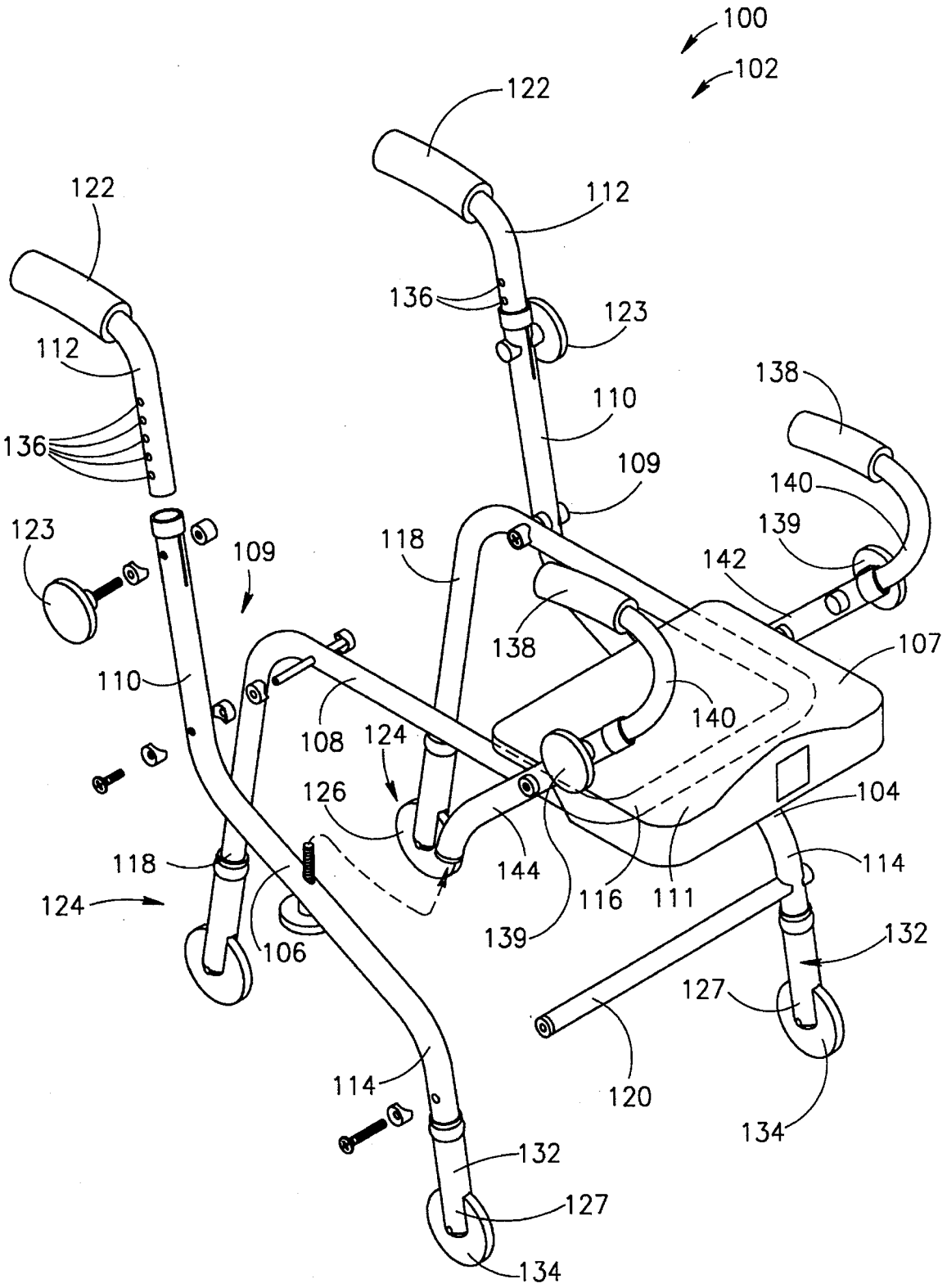
FIG. 1 shows a perspective view of a rollable walker for traversing stairs and substantially level surfaces constructed and operative according to the teachings of the present invention.
Figure 2:
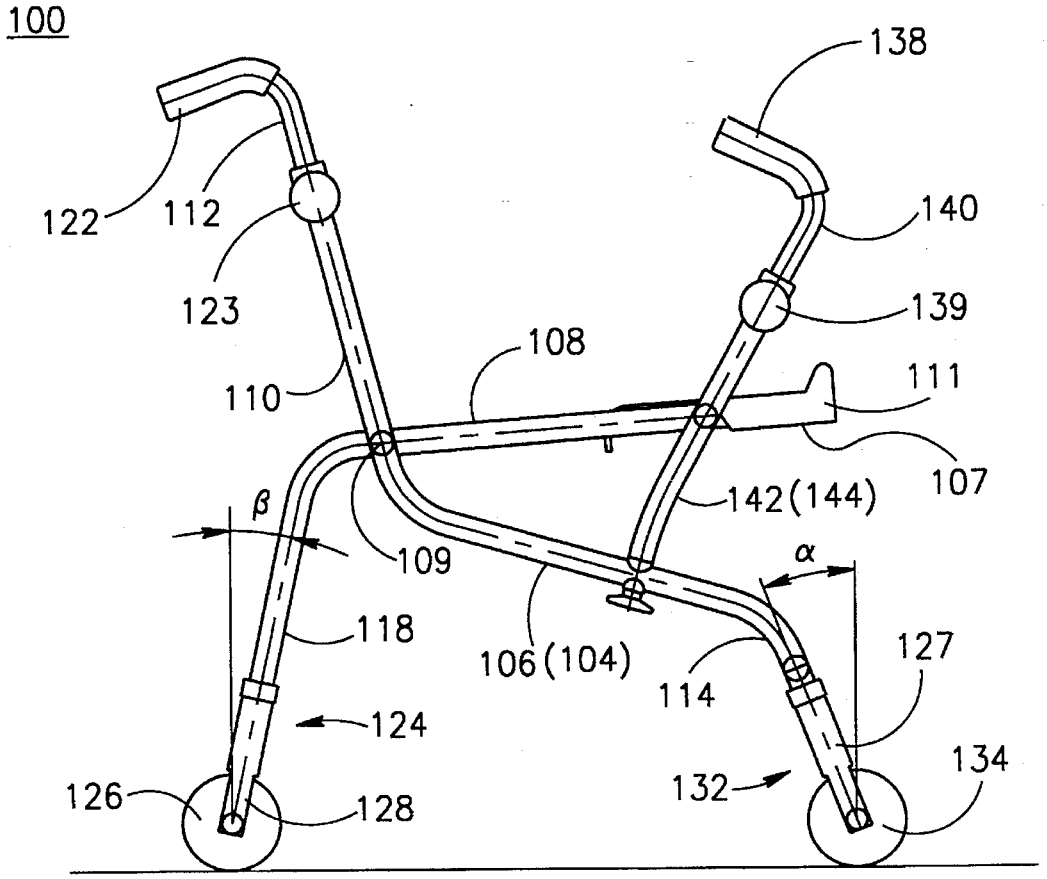
FIG. 2 shows a side view of the walker of FIG. 1.
Figure 3:
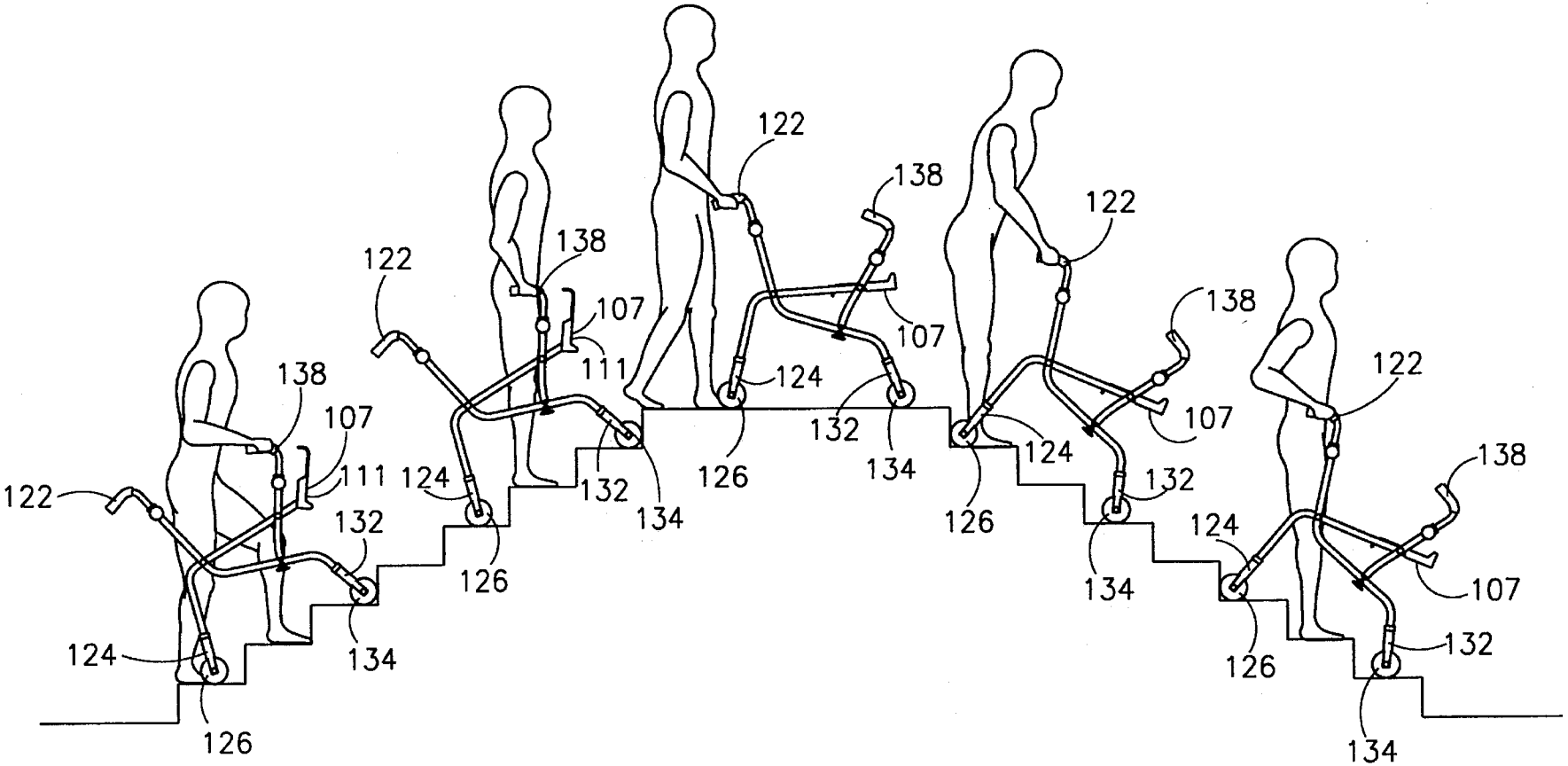
FIG. 3 shows the walker of FIGS. 1 and 2 supporting three modes of ambulation: traversing substantially level surfaces, descending stairs and ascending stairs.

With reference now to FIGS. 1–3, there is shown a walker, generally designated 100, constructed and operative according to the teachings of the present invention, for traversing stairs as well as substantially level surfaces. Hence, walker 100 is adapted to provide support in three modes of ambulation: ascending, descending stairs and traversing substantially level surfaces.

Walker 100 includes a frame 102 fabricated from left and right upright members 104 and 106 and a first crossbar 108. Members 104 and 106 include upper segments 110 for telescopically receiving push handle tubes 112 and lower segments in the form of front legs 114, while crossbar 108 includes a generally U-shaped transverse element 116 and substantially vertically disposed segments in the form of rear legs 118. A second crossbar 120 can be deployed either connected or integrally formed with members 104 and 106 for strengthening frame 102. A foldable seat 107 and/or a basket (not shown) can also be provided as known in the art.

For traversing substantially level surfaces, walker 100 includes a first pair of handles 122 mounted on push handle tubes 112 and braking devices 124 for stopping rear wheels 126 telescopically mounted on rear legs 118 via rear wheel mounts 128. As will be described below in greater detail, rear wheel mounts 128 are telescopically accommodating rear legs 118 such that rear legs 118 and rear wheel mounts 128 are vertically slidable with respect to one another for automatic activation of braking devices 124 when the user applies a downward force on frame 102 greater than a pre-determined value. Hence, in a sense, braking devices 124 act in a reverse manner to the deadman's handle found in locomotives and other means of transport. Benefits of equipping walker 100 with automatically actuated braking devices 124 rather than hand-operated devices, for example, squeeze-and-stop brakes deployed on bicycles and various walkers, include that less co-ordination and attention is required of the user. In particular, braking devices 124 are engineered such that a total load on frame 102 of less than the typical weight of a user is sufficient to cause a braking action. Hence, the pre-determined value typically lies between about 20 Newton and about 60 Newton.

When walker 100 is on a substantially level surface, handles 122 are substantially deployed over and slightly forward of rear wheels 126 such that pressure applied on frame 102 during ambulation brakes walker 100 via automatic actuation of rear braking devices 124, thereby providing a firm footing for the user. Handles 122 are preferably mounted on push handle tubes 112 telescopically received by upper segments 110 such that the height of handles 122 can be adjusted to accommodate different heights of users. Adjustment of the height of handles 122 is typically achieved by the use of height adjustment handles 123 which are threaded through one pair of a series of pairs of transverse holes 136 provided in push handle tubes 112. The height of handles 112 is preferably adjusted so as to be half of the height of the user.

Walker 100 includes elements and design considerations for enabling the descending of stairs as now described. For descending stairs, handles 122 are mounted, as described, on push handle tubes 112 and braking devices 132 for stopping front wheels 134 telescopically mounted on front legs 114 via front wheel mounts 127 in a manner similar to as described above for braking devices 124. As shown in FIG. 3, the location of handles 122 while descending stairs is selected substantially above a stair which is located between stairs engaging front 134 and rear 126 wheels, therefore, when weight is applied by a user onto frame 102 while descending stairs automatically actuates both front 132 and rear 124 braking devices.

Furthermore, walker 100 includes elements and design considerations for enabling the ascending of stairs as now described. For ascending stairs, walker 100 includes a second pair of handles 138 mounted on push handle tubes 140 telescopically received by additional left and right upright members 142 and 144 extending from upright members 104 and 106, respectively. It is noted by those with skills in the art that left and right upright members 142 and 144 act as supporting means to support walker 100 in its operative non-folded position.

As shown in FIG. 3, when walker 100 is used for ascending stairs, handles 138 are deployed substantially above a non-occupied stair located between stairs engaged by rear 126 and front 134 wheels, such that pressure applied on frame 102 while ascending stairs brakes walker 100 through rear 124 and front 132 braking devices, thereby providing a firm footing for the user. The height of handles 138 are adjustable in a manner similar to as described above for handles 122, using height adjustment handles 139 such that their height above the stair which the user is ascending is slightly less then half the height of the user.

Other design considerations implemented by walker 100 for traversing stairs having an inclination of approximately 30° are as follows:

First, wheel base (i.e., the distance between front 134 and rear 126 wheels) of walker 100 is extended to include at least one non-occupied stair between front wheels 134 and rear wheels 126 such that the wheel base is typically 800 mm for rendering greater stability to walker 100.

Second, when walker 100 is on a substantially level surface, the angle $\alpha$ that front legs 114 are inclined to the vertical is approximately the same as the inclination of the stairs such that they are substantially vertical when walker 100 is used for descending stairs. Typically, $\alpha$ equals 30°. An advantage rendered by this design consideration is that it ensures that braking devices 132 operate as effectively as possible against front wheels 134 which are substantially vertical when walker 100 is used for descending stairs.

Third, when walker 100 is on a substantially level surface, the angle $\beta$ that rear legs 118 are inclined to the vertical is approximately half the inclination of the stairs such that they are substantially vertical when walker 100 is used both for traversing substantially level surfaces and for ascending stairs. Typically $\beta$ equals 15°. An advantage rendered by this design consideration is that it ensures that rear braking devices 124 operate as effectively as possible against rear wheels 126 which carry most of the load borne by walker 100 when traversing substantially level surfaces or ascending stairs.

And finally, handles 138 and 122 when used for descending and ascending stairs, respectively, are located substantially above a non-occupied stair located between stairs engaged by front 134 and rear 126 Wheels, thereby the actuation of both front 132 and rear 124 braking devices is enabled thus ensuring a firm footing of walker 100 when used for traversing stairs.

Figure 4:
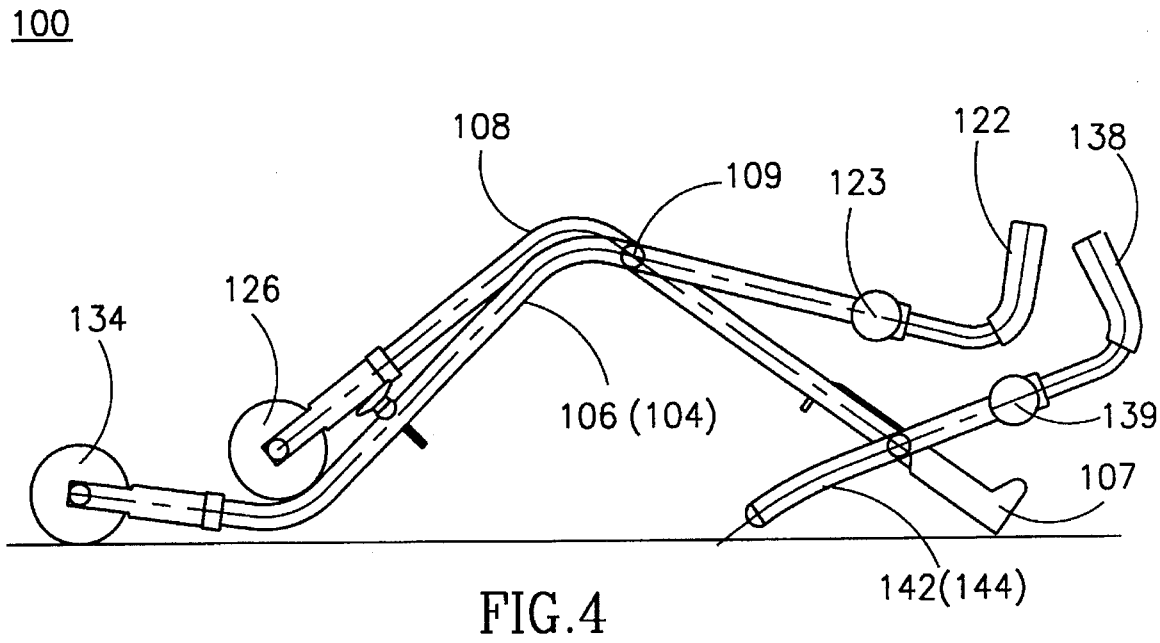
FIG. 4 shows a side view of the walker of FIGS. 1 and 2 in its folded arrangement.

With reference now to FIGS. 2 and 4, walker 100 can be designed to be foldable by pivotaly mounting crossbar 108 to left and right frame members 104 and 106 about pivot 109. In the folded arrangement, the minimum storage dimension of walker 100 is approximately 300 mm.

The three modes of ambulation supported by walker 100 are now described with reference back to FIGS. 1–3. After adjustment of the height of handles 122 such that they are approximately half of the height of the user, the user accomplishes ambulation over substantially level surfaces by gripping handles 122 and repetitively rolling walker 100 forward and taking a step while relying on walker 100 for a firm footing facilitated by the automatic braking of rear wheels 126 by braking devices 124.

On reaching descending stairs, the user still grips handles 122 and descends the stairs by repetitively performing the following steps. First, he rolls walker 100 forward such that front wheels 134 are lowered onto the stair two stairs down from where he is standing. Second, he stabilizes walker 100 by urging rear wheels 124 against the wall between the stair that he is standing and the stair above it. And finally, he climbs down a stair while relying on walker 100 for a firm footing facilitated by the automatic braking of front wheels 134 by braking devices 132 such that he is standing on the non-occupied stair between front wheels 134 and rear wheels 126.

On reaching ascending stairs, after adjustment of handles 138 to an appropriate height, the user flips over foldable seat 107 (if one is included) around hinge 111, grips handles 138 and ascends the stairs by repetitively performing the following steps. First, he lifts front wheels 134 enough off the ground to clear the height between two adjacent stairs and then rolls walker 100 forward on its rear wheels 126. At this time, he is typically standing toward the rear of frame 102. Second, he stabilizes walker 100 by urging front wheels 134 against the wall between two adjacent stairs. Third, he climbs a stair while relying on walker 100 for a firm footing facilitated by the automatic braking of rear wheels 126 by braking devices 124. At this time, the user is typically standing toward the front of frame 102.

Figure 5:
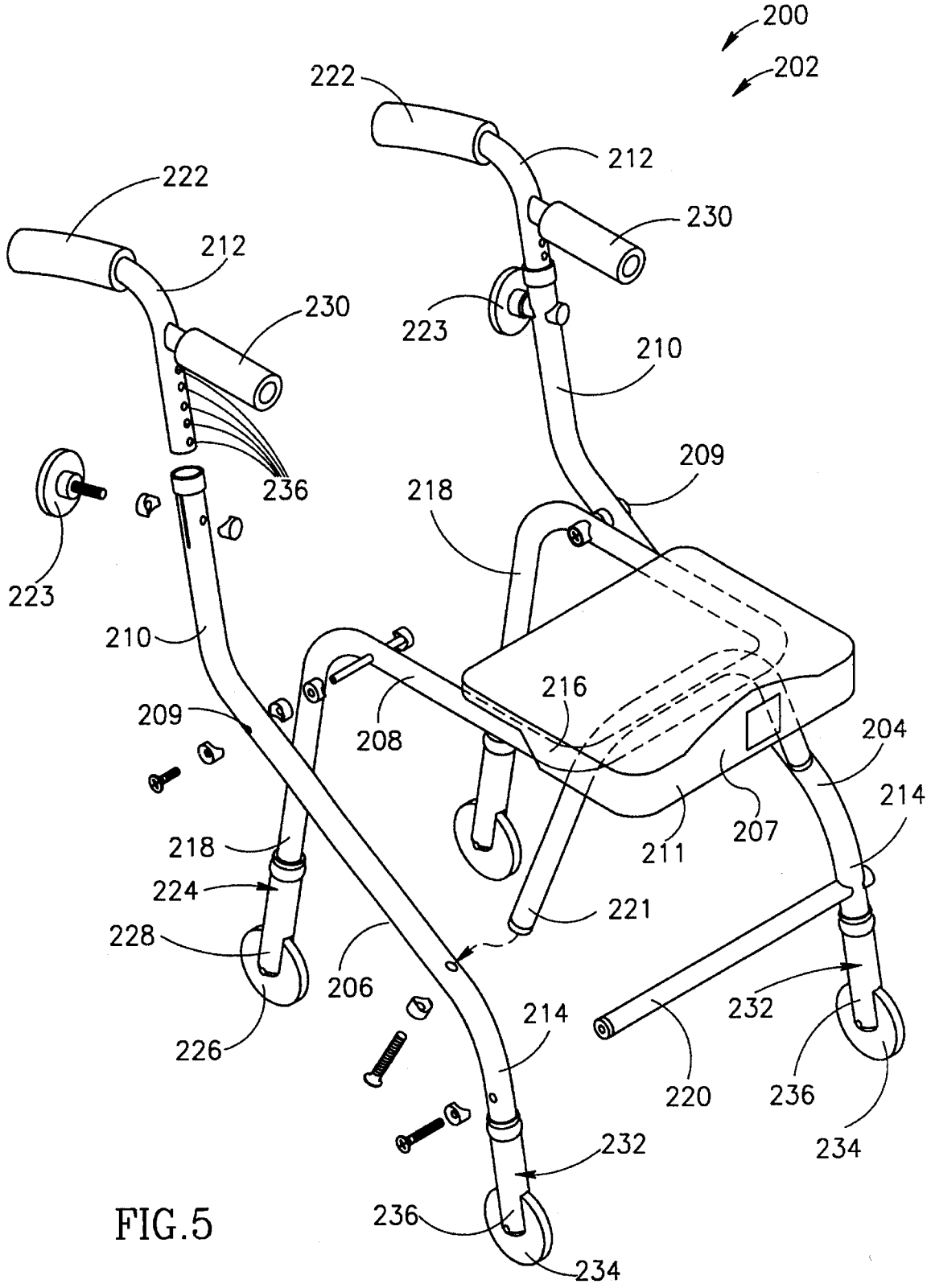
FIG. 5 shows a perspective view of a second rollable walker for traversing stairs and substantially level surfaces constructed and operative according to the teachings of the present invention.
Figure 6:
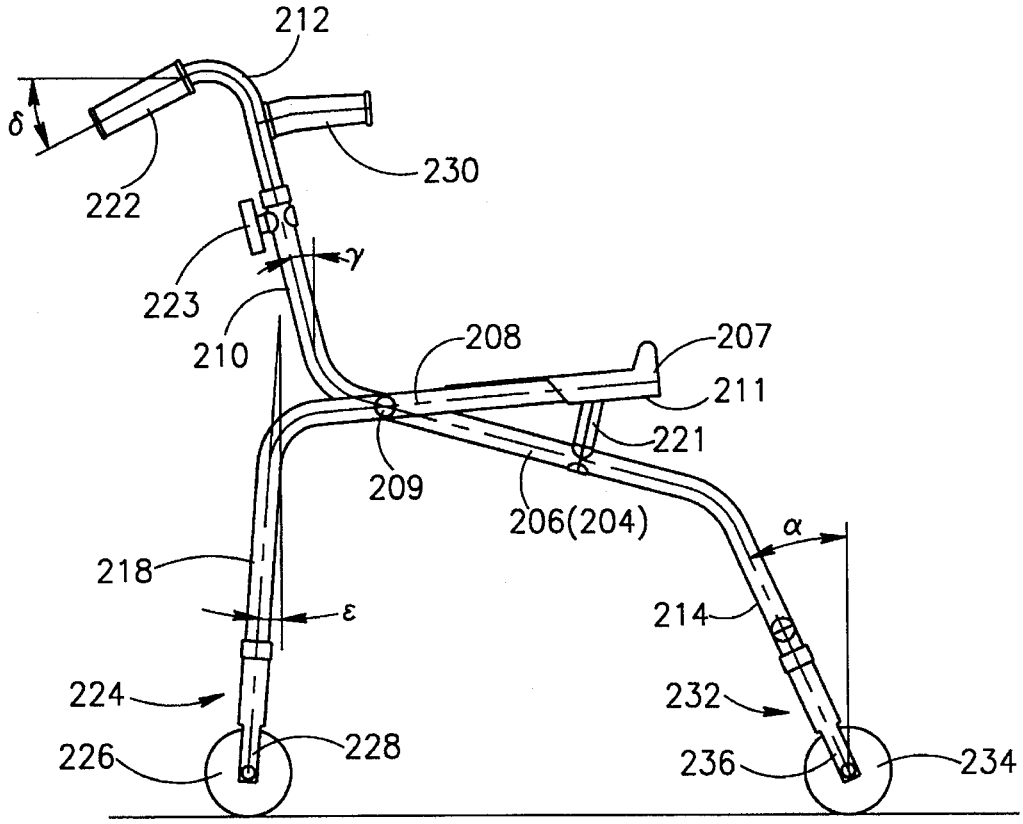
FIG. 6 shows a side view of the walker of FIG. 5.
Figure 7:
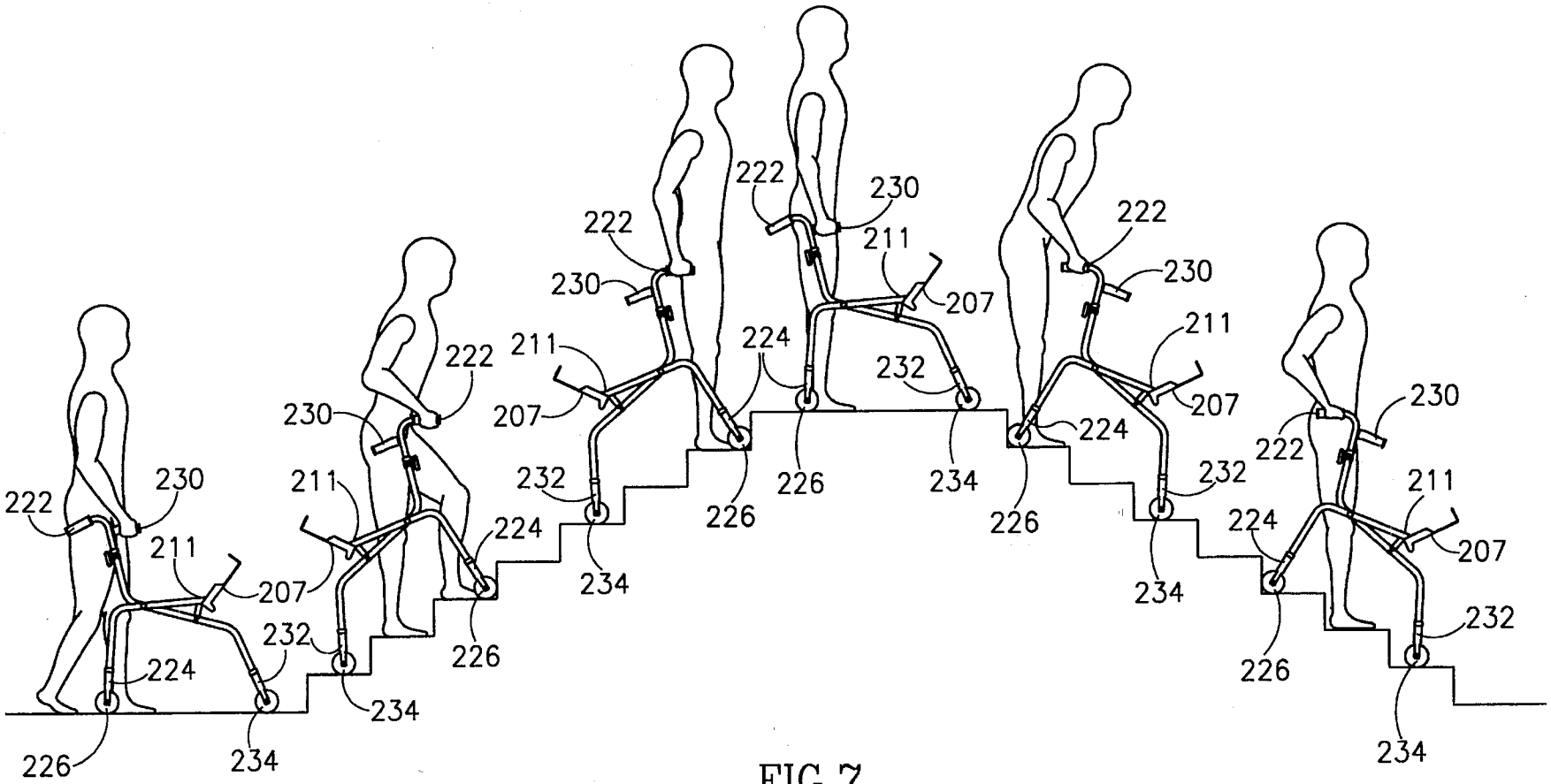
FIG. 7 shows the walker of FIGS. 5 and 6 supporting three modes of ambulation: traversing substantially level surfaces, descending stairs and ascending stairs.

With reference now to FIGS. 5–7, there is shown a walker, generally designated 200, constructed and operative according to the teachings of the present invention, for traversing stairs as well as substantially level surfaces. Hence, like walker 100, walker 200 is adapted to provide support in three modes of ambulation: ascending stairs, descending stairs and traversing substantially level surfaces where distinction is made between ascending and descending stairs because a user takes up different postures requiring different modes of support depending on the direction that the stairs are traversed.

Walker 200 has a similar construction as walker 100 in that it includes a frame 202 fabricated from left and right upright members 204 and 206 and a crossbar 208. As before, members 204 and 206 include upper segments 210 for telescopically receiving push handle tubes 212 and lower segments in the form of front legs 214 while crossbar 208 includes a generally U-shaped transverse element 216 and vertically disposed segments in the form of rear legs 218. A second crossbar 220 can be deployed for strengthening frame 202. And a third crossbar 221 is deployed acting as a supporting means to support U-shaped transverse element 216 of crossbar 208 when walker 200 is in its operative non-folded position. A foldable seat 207 and/or a basket (not shown) can also be provided as known in the art.

For traversing substantially level surfaces, walker 200 includes a first pair of handles 230 mounted on push handle tubes 212 and braking devices 224 for stopping rear wheels 226 telescopically mounted on rear legs 218 via rear wheel mounts 228, in a manner similar to as described above for walker 100. Handles 230 are substantially deployed over and slightly forward of rear wheels 226 such that pressure applied on frame 202 during ambulation brakes walker 200, thereby providing a firm footing for the user. Height adjustment handles 223 and pairs of holes 236 are employed to adjust the height of handles 230 from the horizontal plane such that it is equal to approximately half of the height of the user.

For descending and ascending stairs, walker 200 includes a second pair of handles 222 mounted on push handle tubes 212 and a second pair of braking devices 232 for stopping front wheels 234 telescopically mounted on front legs 214 via front wheel mounts 236. The height of handles 222 above the stair from which the user is descending is slightly more then the height of handles 230.

It should be noted that the location of handles 222 when walker 200 is used for descending or descending stairs enables both the actuation of rear breaking devices 224 and of front breaking devices 232, to ensure a firm footing for the user.

The three modes of ambulation supported by walker 200 are now described. After adjustment of the height of handles 222 and 230 such that handles 222 are approximately half of the height of the user, the user accomplishes ambulation over substantially level surfaces by gripping handles 230 and repetitively rolling walker 200 forward and taking a step while relying on walker 200 for a firm footing facilitated by the automatic braking of rear wheels 226 by braking devices 224.

On reaching ascending stairs the user reverses walkers 200 orientation in 180° such that rear wheels 226 are now at the front, and flips over foldable seat 207 (if one is included) around hinge 211. The user than grips handles 222 and ascends the stairs by repetitively performing the following steps. First, he lifts rear wheels 226 enough off the ground to clear the height between two adjacent stairs and then rolls walker 200 forward on its rear wheels 226 (now at front). Second, he stabilizes walker 200 by urging rear wheels 226 (now at front) against the wall between two adjacent stairs. Third, he climbs a stair while relying on walker 200 for a firm footing facilitated by the automatic braking of from 234 and rear 226 wheels by braking devices 232 and 224, respectively. At this time, the user is typically standing within and surrounded by frame 202.

On reaching descending stairs, the user grips handles 222, which need no further height adjustment as described above, and descends the stairs by repetitively performing the following steps. First, he rolls walker 200 forward such that front wheels 234 are lowered onto the stair two stairs down from where he is standing. Second, he stabilizes walker 200 by urging rear wheels 224 against the wall between the stair that he is standing and the stair above it. And finally, he climbs down a stair while relying on walker 200 for a firm footing facilitated by the automatic braking of front 234 and rear 226 wheels by braking devices 232 and 224 such that he is standing on the non-occupied stair between front wheels 234 and rear wheels 226.

As can be clearly seen in FIG. 7, when walker 200 is employed for descending or ascending stairs, the line of action of the force applied by the user lies substantially parallel to front legs 214 for efficient operation of braking devices 232 upon such ambulations. Yet, at the same time the actuation of rear breaking devices 224 is enabled by selecting the location of handles 222 substantially above, slightly in front, the non-occupied stair located between the stairs engaged by front 234 and rear 226 wheels, thereby providing the user with a firm footing.

Other design considerations implemented by walker 200 for traversing stairs having an inclination of approximately 30° are as follows:

First, as described, wheel base (i.e., the distance between front 234 and rear 226 wheels) of walker 200 is extended to include one non-occupied stair between front wheels 234 and rear wheels 226 such that the wheel base is typically 800 mm for rendering greater stability to walker 200.

Second, when walker 200 is on a substantially level surface, the angle $\gamma$ that upper segments 210 are inclined to the vertical is approximately half of the inclination of the stairs such that the change of distance from handles 230 to the horizontal plane is equal to the change of distance from handles 222 when the user uses walker 200 to descend or ascend stairs. An advantage rendered by this design consideration is that height adjustment of handles 222 and 230 can be performed at the same time. Typically $\gamma$ equals 15°.

Third, when walker 200 is on substantially level surface, the angle $\delta$ that handles 222 are inclined to the horizontal is approximately the same as the inclination of the stairs such that handles 222 are substantially level when walker 200 is used for descending or ascending stairs. Typically $\delta$ equals 30°. It should be noted that et equals 30° to accommodate the requirement that front legs 214 are maintained substantially vertical to best ensure that braking devices 232 operate as effectively as possible against front wheels 234 in two instances when they are rotated in a clockwise direction with respect to the vertical when descending stairs and when they are rotated in a counterclockwise direction with respect to the vertical when ascending stairs.

Fourth, when walker 200 is on a substantially level surface, the angle $\alpha$ that front legs 214 are inclined to the vertical is approximately the same as the inclination of the stairs such that they are substantially vertical when walker 200 is used for descending or ascending stairs. Typically, $\alpha$ equals 30°. An advantage rendered by this design consideration is that it ensures that braking devices 232 operate as effectively as possible against front wheels 234 when walker 200 is used for descending or ascending stairs.

Fifth, when walker 200 is on a substantially level surface, the angle $\epsilon$ that rear legs 218 are inclined to the vertical is approximately right such that they are substantially vertical when walker 200 is used for traversing substantially level surfaces.

And finally, handles 222 employed for traversing stairs are located substantially above, slightly in front of the non-occupied stair located between stairs engaged by front 234 and rear 226 wheels, therefore the actuation of both front 232 and rear 224 breaking devices are enabled while traversing stairs to ensure a firm footing of the user.

Figure 8:
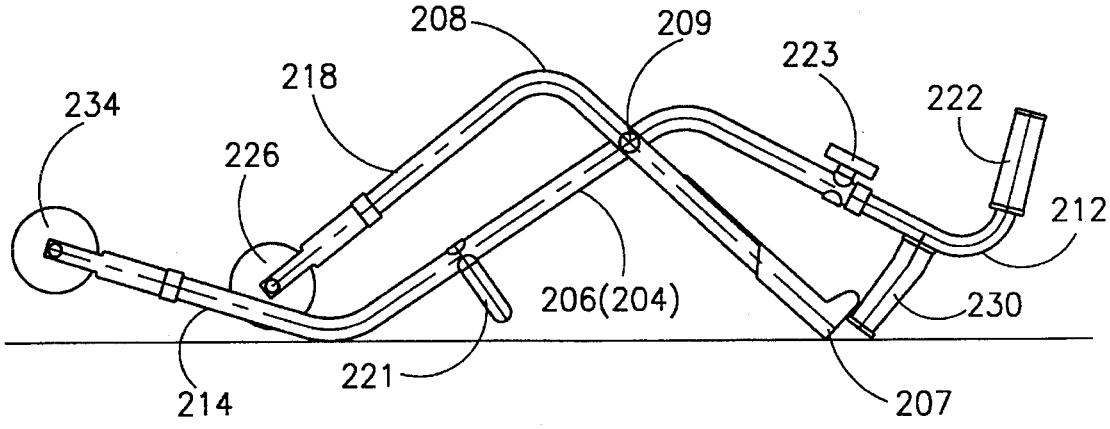
FIG. 8 shows a side view of the walker of FIGS. 5 and 6 in its folded arrangement.

With reference now to FIG. 6 and 8, walker 200 can be designed to be foldable in a similar fashion as walker 100 by pivotaly mounting crossbar 208 to left and right frame members 204 and 206 about pivot 209. In the folded arrangement, the minimum storage dimension of walker 200 is approximately 300 mm.

A common feature characterizing both walker 100 and walker 200 is that handles used for traversing stairs (e.g., handles 222 of walker 200) and/or substantially level surfaces (e.g., handles 230 of walker 200) are deployed horizontally when walkers 100 or 200 are used accordingly. This feature of walkers 100 and 200 ensures firm gripping of the relevant handles by a user upon ambulation.

As described above, walkers 100 and 200 include automatically actuated rear braking devices 124 and 224 and front baking devices 132 and 232, respectively. The automatic operation of these braking devices, all similarly operated, will now be described in details.

Figure 9:
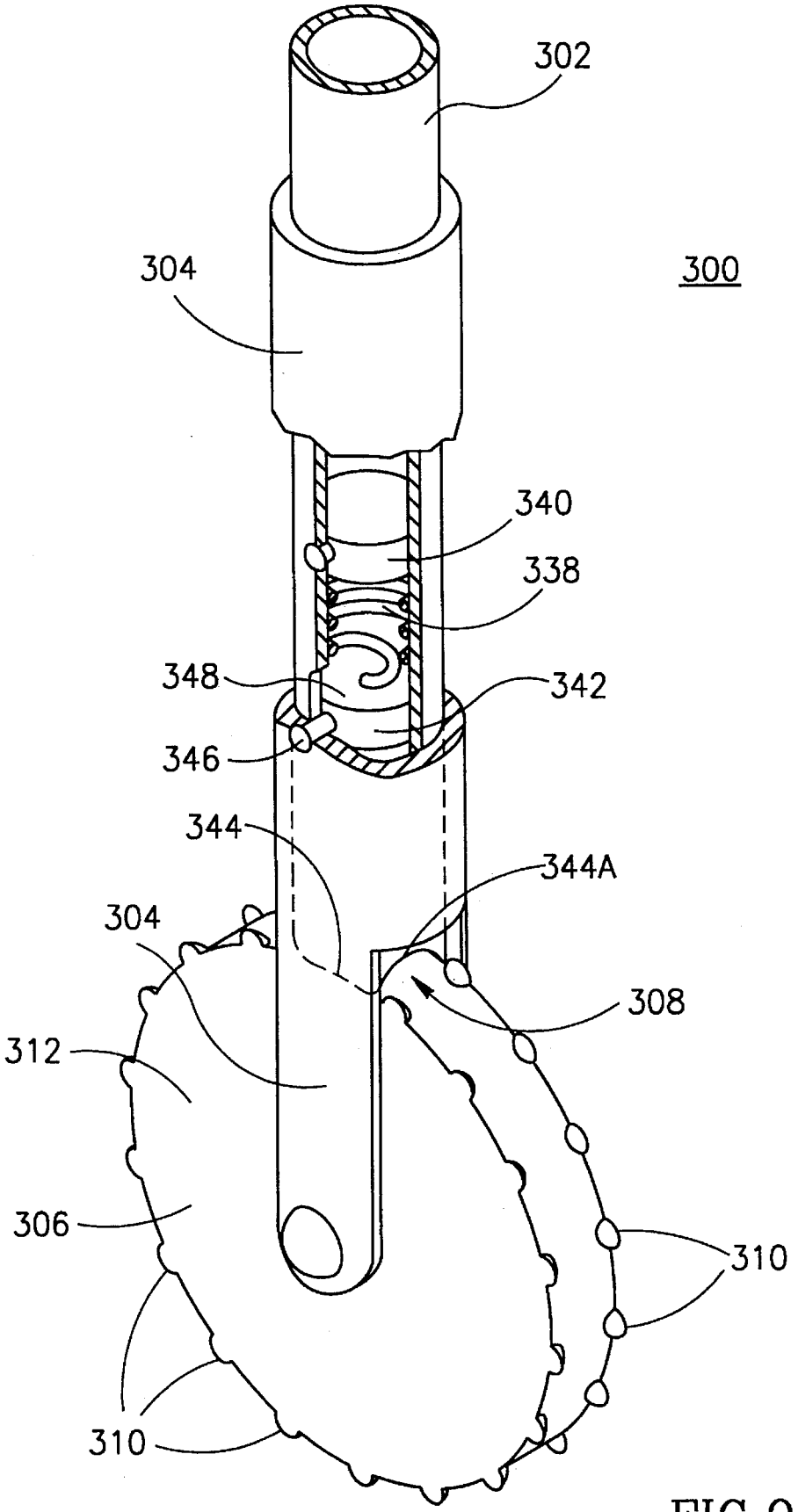
FIG. 9 shows a partly cut-away detailed structural view of a braking device of the walkers.

With reference now to FIG. 9 each of braking devices 124, 224, 132 and 232, collectively termed braking devices 300 hereinbelow, include a compression spring 338 extending between a shoulder 340 rigidly attached to legs 118, 218, 114 and 214, collectively termed legs 300 hereinbelow, and a shoulder 342 rigidly attached to wheel mounts 128, 128, 127 and 227, collectively termed wheel mounts 304 hereinbelow. There are no rigid supports connecting legs 302 to wheel supports 304 and therefore each of compression springs 138 typically bears at least about 25% of the total load borne by walker 100 or 200.

It can therefore be readily appreciated that legs 302 are urged toward wheels 126, 226, 134 and 234, collectively termed hereinbelow wheels 306, when compression springs 138 are compressed on application of a force to frames 102 or 202. In other words, the clearances 308 between lower rims 344 of legs 302 and wheels 306 are governed by the load borne by compression springs 338. Clearances 308 are typically from about 1 mm to about 2 mm when flames 102 or 202 are unloaded. When sufficient load is applied to flames 102 or 202, lower rims 344 are urged against wheels 306 to achieve a braking action of walker 100 or 200, respectively. The vertical displacements of legs 302 with respect to wheels 306 are limited by the travel of inserts 346, traversing legs 302, within vertically aligned slots 348 provided in legs 302.

Rims 344 are preferably configured to receive wheels 306 to increase the contact surface between rims 344 and wheels 306 to facilitate braking of walkers 100 or 200. This is achieved by preparing rims 344 with cutaway portions 344*a* having the same radius of curvature as the traversal radius of curvature of the outer surfaces of wheels 306.

In this case, slots 348 also ensure that a fixed orientation is maintained between legs 302 and wheels 306 such that cutaway portions 344*a* are always aligned to be urged against wheel 306 to effectively brake walkers 100 or 200.

A further feature of braking devices 300 is the application of protrusions 310 to wheels 306. Protrusions 310 are situated around both vertical planar surfaces 312 of wheels 306 and therefore increase the braking effectively of braking devices 300. The effectiveness of braking device 300 is greatly enhanced by pressing rims onto wheels 306 outer circular surfaces, between two adjacent protrusions 310, which protrusions 310 therefore acting as stoppers, while, at no time protrusions 310 are in contact with the surface on which walkers 100 or 200 are rolled.

While the invention has been described with respect to a limited number of embodiment, it will be appreciated that many variations, modifications and other applications of the invention may be made.

What is claimed is:

1. A rollable walker for traversing stairs and substantially level surfaces, comprising:

(a) a frame including:

(i) a left and a right upright member, each of said left and a right upright members including a front leg and an upper segment; and (ii) a crossbar being pivotally connected to said left and right upright members, said crossbar including a generally U-shaped transverse element and two segments being rear legs, said crossbar being supported by supporting means, said supporting means being formed connective with said left and fight upright members;

(b) a pair of rear wheel mounts engaging a pair of rear wheels, each of said rear wheels having two substantially circular planar surfaces, each having a periphery, said rear wheels being connected to said rear legs, said planar surfaces of said rear wheels featuring protrusions proximate said peripheries;

(c) a pair of front wheel mounts engaging a pair of front wheels, each of said front wheels having two substantially circular planar surfaces, each having a periphery, said front wheels being connected to said front legs, said planar surfaces of said front wheels featuring protrusions proximate said peripheries; and (d) two pairs of braking devices connected to said rear and front legs, each of said braking devices being slidably supported over one of said wheels in such a way that the application on said frame of a downward force of a magnitude greater than a pre-determined value urges said braking devices against said wheels and said protrusions to brake the walker.

2. The walker as in claim 1, wherein each one of said braking devices includes a compression spring having one end rigidly mounted to one of said legs and a second end rigidly mounted to one of said wheel mounts such that said compression spring supports at least a portion of the weight of said frame.

3. The walker as in claim 2, wherein each one of said braking devices includes a lower rim of said leg, wherein said lower rim is configured to receive said wheel, such that said compression spring governs the clearance between said lower rim and said wheel as a function of the load borne by said compression spring.

4. The walker as in claim 1, wherein said frame includes a first pair of handles, wherein each one of said handles of said first pair of handles is connected to one of said upper segments and is substantially deployed over one wheel of said pair of rear wheels.

5. The walker as in claim 4, wherein said frame includes a second pair of handles, wherein each one of said handles of said second pair of handles is connected to one of said upper segments below said handles of said first pair of handles and is substantially deployed over one wheel of said pair of rear wheels.

6. The walker as in claim 4, wherein said frame includes a second pair of handles, wherein each one of said handles of said second pair of handles is connected to said supporting means and is substantially deployed over one wheel of said pair of front wheels.

7. The walker as in claim 5, wherein said from legs form an angle with the vertical, said angle substantially equals 30°.

8. The walker as in claim 6, wherein said front legs form an angle with the vertical, said angle substantially equals 30°.

9. The walker as in claim 8, wherein said rear legs form an angle with the vertical, said angle substantially equals 15°.

10. The walker as in claim 1, further comprising a foldable seat connected to said frame for supporting a user in a sitting position.

11. The walker as in claim 1, wherein said front legs form an angle with the vertical, said angle substantially equals to 30°.

12. The walker as in claim 1, wherein said rear legs form an angle with the vertical, said angle substantially equals to 15°.

* * * * *